US009047723B2

(12) United States Patent
Chen

(10) Patent No.: US 9,047,723 B2
(45) Date of Patent: Jun. 2, 2015

(54) DEFECT CATEGORIZATION

(71) Applicant: NCR CORPORATION, Duluth, GA (US)

(72) Inventor: Ping Chen, Beijing (CN)

(73) Assignee: NCR Corporation, Duluth, GA (US)

( * ) Notice: Subject to any disclaimer, the term of this patent is extended or adjusted under 35 U.S.C. 154(b) by 34 days.

(21) Appl. No.: 14/068,832

(22) Filed: Oct. 31, 2013

(65) Prior Publication Data

US 2015/0117746 A1 Apr. 30, 2015

(51) Int. Cl.
*G07D 7/16* (2006.01)
*G07D 7/20* (2006.01)

(52) U.S. Cl.
CPC ..... *G07D 7/164* (2013.01); *G07D 7/2025* (2013.01)

(58) Field of Classification Search
None
See application file for complete search history.

(56) References Cited

U.S. PATENT DOCUMENTS 4,446,735 A * 5/1984 Weilacher ..... 73/597
2005/0075801 A1* 4/2005 Skeps et al. ..... 702/35
2011/0224918 A1* 9/2011 Floeder et al. ..... 702/35

OTHER PUBLICATIONS

WillsEye Hospital. "Ultrasound Pachymetry." Oct. 5, 2011. Accessed Jan. 21, 2015. http://www.willseye.org/health-library/ultrasound-pachymetry.*

Hiroshi Sako; Technologies for developing an advanced intelligent ATM with self-defence capabilities. Proc. SPIE 7534, Document Recognition and Retrieval XVII, 75340E (Jan. 18, 2010); doi:10.1117/12.838724.*

* cited by examiner

*Primary Examiner* — Stephen R Koziol
*Assistant Examiner* — Kate R Duffy

(57) ABSTRACT

A method of categorizing defects in a media item is described. The method comprises the steps of: receiving an ultrasonic image of the media item, where the ultrasonic image comprises a plurality of points, each point having a thickness value corresponding to a normal value, a thin value, or a thick value; identifying one or more blobs comprising contiguous points each having a thickness value corresponding to a thin value; for each identified blob, comparing a size of the blob with a damage criterion; ignoring the blob if the blob size does not meet the damage criterion; and for each identified blob having a size meeting the damage criterion, categorizing the identified blob using the thickness values and locations.

12 Claims, 8 Drawing Sheets

```
302
300 { DefectProfile.Hole.Area=10;          304
      DefectProfile.Hole.Logic='None';
                                          312
310 { DefectProfile.CornerFold.Area=130;  314
      DefectProfile.CornerFold.Length=10; 316
      DefectProfile.CornerFold.Logic='And';
                                          322
320 { DefectProfile.MissingPortion.Length=6;  324
      DefectProfile.MissingPortion.Width=5;   326
      DefectProfile.MissingPortion.Logic='Or';
```

DEFECT CATEGORIZATION

FIELD OF INVENTION

The present invention relates to defect categorization. In particular, though not exclusively, the invention relates to automated defect categorization in media items, such as those deposited in self-service terminals (SSTs). The invention also relates to media item assessment based on categorized defects.

BACKGROUND OF INVENTION

Some SSTs, such as automated teller machines (ATMs), can receive media items in the form of banknotes (or cheques) deposited by a customer.

Some currency issuing authorities (such as the European Central Bank) have mandated that banks should capture and return to that authority any of its currency that is deemed unfit for continued circulation. This is relatively easy to implement when currency is handed to a bank teller because the teller can physically inspect the banknotes, but it is more difficult to implement when banknotes are deposited in ATMs because no human teller is involved.

SUMMARY OF INVENTION

Accordingly, the invention generally provides methods, systems, apparatus, and software for automatically categorizing defects in media items.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a method of categorizing defects in a media item, the method comprising the steps of: receiving a quantized ultrasonic image of the media item, where the quantized ultrasonic image comprises a plurality of points, each point having a thickness value corresponding to a normal value, a thin value, or a thick value; identifying one or more blobs comprising contiguous points each having a thickness value corresponding to a thin value; for each identified blob, comparing a size of the blob with a damage criterion; ignoring the blob if the blob size does not meet the damage criterion; and for each identified blob having a size meeting the damage criterion, categorizing the identified blob using the thickness values and locations.

As used herein, an ultrasonic image is a non-optical image.

As used herein, a "blob" comprises contiguous points in an ultrasonic image that all have a similar property (for example, a thickness value) that is different to the corresponding property (in this example, the thickness value) of the surrounding points.

A blob may comprise a contiguous area of points having a thin thickness value; alternatively, a blob may comprise a contiguous area of points having a thick thickness value.

The step of identifying one or more blobs may comprise using a region growing algorithm (one example of this is described in *IEEE Region Growing: A New Approach* S. A. Hoijatoleslami and J. Kittler *TRANSACTIONS ON IMAGE PROCESSING, VOL.* 7, *NO.* 7, Jul. 1998 page 1079-1084), a split and merge algorithm (one example of this is described in S. L. Horowitz and T. Pavlidis, *Picture Segmentation by a Directed Split and Merge Procedure, Proc. ICPR,* 1974, Denmark, pp. 424-433) or any other convenient algorithm. These two algorithms are computationally intensive.

Advantageously, the step of identifying one or more blobs may comprise a modified union-find structure algorithm.

The modified union-find structure algorithm may comprise: identifying on each row of the quantised image, each group of points that are contiguous and that have the same thickness value that is different to the normal thickness value; identifying for each row boundary, (i) each group in an upper row that at least partially overlaps with a group on the lower row, and merging these two groups into a new single group as a growing blob, (ii) each group in an upper row that does not overlap a group on the lower row, and characterizing each such group in the upper row as a complete blob, and (iii) each group in the lower row that does not overlap a group on the upper row, and characterizing each such group as a growing blob. When the modified union-find structure algorithm is complete, then one or more complete blobs are identified.

Preferably, for each complete blob, the blob location, size and dimensions are stored.

The damage criterion may comprise a damage threshold, such that if the blob size is smaller than (or smaller than or equal to) the damage threshold then the blob size does not meet the damage criterion; whereas, if the blob size is larger than or equal to (or larger than) the damage threshold then the blob size does meet the damage criterion.

The step of categorizing the identified blob may include the categories of: tear, missing portion (including missing corner), corner fold, and hole.

The step of categorizing the identified blob may comprise the further step of: (a) categorizing the identified blob as a hole if the blob does not touch one of the edges of the media item. If an identified blob has no connection to an edge of the media item, it may be categorized as a hole.

The step of categorizing the identified blob may comprise the further step of: (b) if the identified blob does touch one of the edges of the media item but is not at one of the corners of the media item, then categorizing the identified blob as a tear/missing portion. Whether the identified blob is a tear or a missing portion depends on the size of the identified blob, so the step of categorizing the identified blob may comprise the further step of comparing the size of the identified blob with a maximum tear size to categorize the identified blob as a tear or as a missing portion.

The step of categorizing the identified blob may comprise the further step of: (c) if the identified blob does touch one of the corners of the media item then ascertaining if the identified blob is a corner fold.

The step of ascertaining if the identified blob is a corner fold may include comparing point values from a potential corner overlap region with point values from a neighbouring non-overlap region.

The step of categorizing the identified blob may comprise the further step of: (d) if the identified blob does touch one of the corners of the media item but is not a corner fold, then categorizing the identified blob as a missing portion, or more precisely a missing corner if required.

The step of categorizing the identified blob may comprise the further step of: (e) if the identified blob does touch one of the corners of the media item and is a corner fold, then categorizing the identified blob as a corner fold.

The method of categorizing defects in a media item may comprise the further steps of: identifying one or more blobs comprising contiguous points each having a thickness value corresponding to a thick value; for each identified blob, comparing a size of the blob with a damage criterion; ignoring the blob if the blob size does not meet the damage criterion; and for each identified blob having a size meeting the damage criterion, categorizing the identified blob as tape if it is not connected to a blob comprising contiguous points each having a thickness value corresponding to a thin value.

As used herein, the category of "tape" includes any additions to the media item, such as glue, sticky paper, plastic stuck or melted onto the media item, or the like.

The method may comprise the additional step of applying fitness rules to the categorized blobs to ascertain if the media item should be classified as unfit.

The fitness rules may comprise a different set of rules for each category of defect. For example, a media item may be rejected as unfit if it has a hole larger than or equal to ten millimeter square (10 $mm^2$); or if a corner fold has a shorter edge longer than or equal to ten millimeter (10 mm) and its area is larger than or equal to 130 $mm^2$.

The method may comprise the additional step of capturing an ultrasonic image of the media item. An ultrasonic image may be captured using a plurality of ultrasound transceivers.

The method may comprise the additional step of creating a quantised image from the captured ultrasonic image prior to the step of receiving a quantised ultrasonic image of the media item.

Each point in the quantised image may have one of three values. In other words, two thresholds may be used to convert each point to one of three different values. This may be referred to as dual binarization.

The method may comprise the additional step of adjusting spatial dimensions of the received image so that the received image matches spatial dimensions of a reference for that media item or an optical image of that media item. This compensates for any media items that have added portions (such as adhesive tape) or have shrunk or expanded, or the like. Techniques for automatically aligning a captured image with a reference image, and then cropping or adding to the captured image to match the spatial dimensions of the reference image are well known in the art.

According to a second aspect there is provided a media validator operable to categorize defects on a media item presented thereto, the media validator comprising: a media item transport for transporting a media item; an ultrasonic transceiver aligned with the media item transport and for capturing a two-dimensional array of points corresponding to the media item, each point having a point value relating to a thickness of the media item at a spatial location on the media item corresponding to that point; and a processor programmed to control the media transport and the ultrasonic transceiver, and also programmed to: (a) quantise the captured array of points to create a quantised ultrasonic image, (b) identify one or more blobs comprising contiguous points each having a point value corresponding to a thin value, (c) ascertain if which identified blobs meet a damage criterion, and (d) categorize those identified blobs meeting the damage criterion.

The processor may further implement the additional steps recited with respect to the first aspect.

The media item transport may comprise one or more endless belts, skid plates, rollers, gear trains, or the like.

The media validator may comprise a banknote validator. The banknote validator may be incorporated into a media depository, which may be incorporated into a self-service terminal, such as an ATM.

According to a third aspect there is provided a computer program programmed to implement the steps of the first aspect. The computer program may be executed by a media validator.

According to a fourth aspect there is provided a defect profile configuration file, the file comprising: a defect type parameter; a defect size field; and a logic parameter.

The defect type may comprise an absence-type of defect in a media item. An absence-type of defect is where there is no substrate at a portion of the media item where there should be a substrate.

The defect configuration file may comprise a plurality of defect size parameters within the defect size field.

Each defect size parameter may comprise: a defect length parameter, a defect width parameter, or a defect area parameter.

The logic parameter may be used to indicate how the defect size parameters are associated. For example, if a defect type parameter is a "Missing Portion", and if a defect length is 6 mm and a defect width is 5 mm, and the logic parameter is "OR", then a media item will be identified as unfit if it has an identified blob categorized as a missing portion having either a width exceeding or equal to 5 mm or a length exceeding or equal to 6 mm.

According to a fifth aspect there is provided a method of characterizing a media item as unfit, the method comprising: implementing the method of the first aspect to categorize defects in the media item; for each categorized defect, accessing a defect profile configuration file to retrieve (i) a defect type matching the categorized defect, and (ii) a defect size associated with that defect type; and characterizing the media item as unfit if a categorized defect includes a dimension greater than or equal to a defect size for that defect type.

According to a sixth aspect there is provided a media validator programmed to implement the fifth aspect.

The media validator preferably implements additional media item processing functions, such as media item recognition, validation, stain detection, wear detection, extraneous matter detection, and the like.

The media item may comprise a banknote.

According to a seventh aspect there is provided a method of categorizing defects in a media item, the method comprising the steps of: receiving a quantized ultrasonic image of the media item; identifying one or more blobs comprising contiguous points each having an abnormal thickness value; for each identified blob, comparing a size of the blob with a damage criterion; ignoring the blob if the blob size does not meet the damage criterion; and for each identified blob having a size meeting the damage criterion, categorizing the identified blob using the thickness value and location of that identified blob.

The abnormal thickness value may comprise a low thickness value; alternatively, the abnormal thickness value may comprise a high thickness value.

According to an eighth aspect there is provided a method of categorizing defects in a media item, the method comprising the steps of: receiving an ultrasonic image of the media item; identifying one or more blobs having an abnormal thickness value; and categorizing an identified blob using the thickness value and location of that identified blob.

For clarity and simplicity of description, not all combinations of elements provided in the aspects recited above have been set forth expressly. Notwithstanding this, the skilled person will directly and unambiguously recognise that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

DETAILED DESCRIPTION

Figure 1:
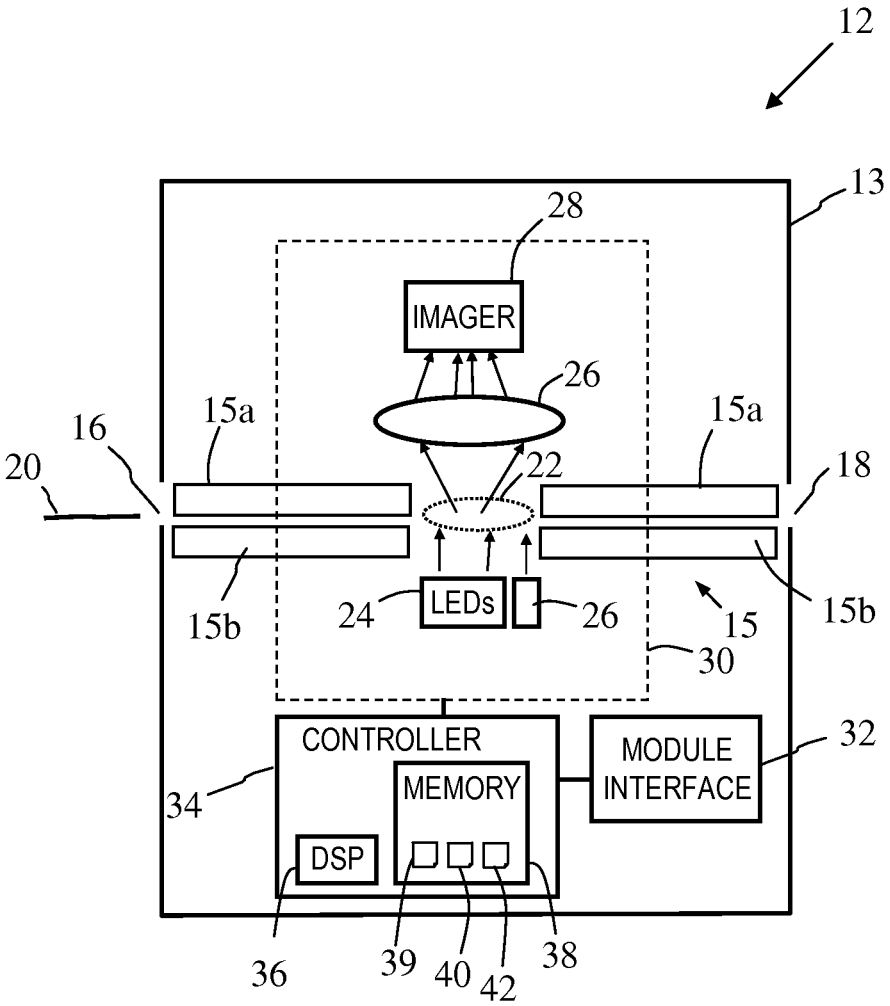
FIG. 1 is a simplified schematic diagram of a defect categorization system comprising a media validator for implementing a method of categorizing defects on a media item inserted therein according to one embodiment of the present invention.

Reference is first made to FIG. 1, which is a simplified schematic diagram of a defect categorization system comprising a media item validator 12 (in the form of a banknote validator) for implementing a method of categorizing defects on a media item (and also for assessing the fitness of the media item) according to one embodiment of the present invention.

The banknote validator 12 comprises a housing 13 supporting a transport mechanism 15 in the form a train of pinch rollers comprising upper pinch rollers 15*a* aligned with lower pinch rollers 15*b*, extending from an entrance port 16 to a capture port 18.

The entrance and capture ports 16,18 are in the form of apertures defined by the housing 13. In use, the capture port 18 would typically be aligned with parts of a depository module.

In use, the pinch rollers 15*a,b* guide a media item (in this embodiment a banknote) 20 short edge first through an examination area 22 defined by a gap between adjacent pinch roller pairs. While the banknote 20 is being conveyed through the examination area 22, the banknote 20 is illuminated selectively by illumination sources 24, such as infra-red LEDs. Additional illumination sources are provided for other functions of the banknote validator 12 (for example, banknote recognition, identification, counterfeit detection, and the like), but these are not relevant to this embodiment, so will not be described herein.

When the infra-red LEDs 24 are illuminated, the emitted infra-red radiation is incident on an underside of the banknote 20, and an optical lens 26 focuses light transmitted through the banknote 20 to the optical imager 28 (in this embodiment a CCD contact image sensor (CIS)). This provides a transmitted infra-red channel output from the optical imager 28.

A linear array of ultrasonic sensors 30 is also provided at the examination area 22 for capturing ultrasonic measurements of the width of a banknote 20 as it is conveyed through the examination area 22. By capturing measurements from successive strips of the banknote 20 as the banknote 20 is transported across the examination area 22, the linear array of ultrasonic sensors 30 captures a two dimensional array of points corresponding to the dimensions of the banknote 20.

The banknote validator 12 includes a data and power interface 32 for allowing the banknote validator 12 to transfer data to an external unit, such as an ATM (not shown) a media depository (not shown), or a PC (not shown), and to receive data, commands, and power therefrom. The banknote validator 12 would typically be incorporated into a media depository, which would typically be incorporated into an ATM.

The banknote validator 12 also has a controller 34 including a digital signal processor (DSP) 36 and an associated memory 38. The controller 34 controls the pinch rollers 15, the LEDs 24, and the linear array of ultrasonic sensors 30. The controller 34 also collates and processes data captured by the optical imager 28 and the linear array of ultrasonic sensors 30, and communicates this data and/or results of any analysis of this data to the external unit via the data and power interface 32.

Figure 2:
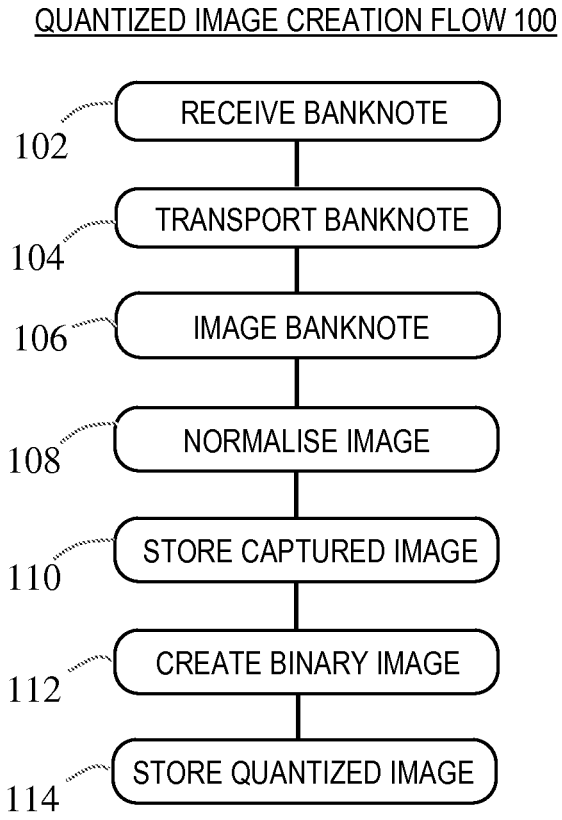
FIG. 2 is a flowchart illustrating steps performed by the media validator of FIG. 1 in capturing and processing an ultrasonic image of a media item as part of defect categorization and media item fitness assessment.

Reference is now also made to FIG. 2, which is a flowchart 100 illustrating steps performed by the banknote validator 12 (as controlled by the DSP 36) to capture a quantised ultrasonic image of the banknote 20.

Initially, a banknote 20 is inserted into the validator 12, which the banknote validator 12 receives (step 102).

The controller 34 then transports the banknote 20 to the examination area 22 (step 104) and causes the image collection component to capture an optical image of the banknote 20 and the ultrasonic sensors 30 to capture an ultrasonic image of the banknote 20 (step 106).

It should be appreciated that the optical image capture process may be used for multiple different purposes. For example, a captured optical image may be used for banknote recognition, stain detection, and other purposes. Furthermore, additional optical images (such as red and green channel images) may be captured at the same time for use in validating the banknote. In other words, the banknote validator 12 may include other light sources (for example, a green light source), not shown in FIG. 1 for clarity. However, these other features and purposes are not essential to an understanding of this embodiment, so they will not be described in detail herein. It is sufficient for the skilled person to realise that the same banknote validator may be used to perform multiple functions relating to media assessment.

Once an ultrasonic image of the banknote 20 has been captured, the image is normalised by the DSP 36 so that the captured ultrasonic image matches the size of the optical image captured from that banknote (step 108). This can be implemented by identifying the corner coordinates from the optical image and mapping these corner coordinates to the ultrasonic image to indicate the edges of the ultrasonic image.

The DSP 36 stores the normalised image in the memory 38 as a raw image file 39 (with each point in the image having a value indicative of a thickness of the banknote 20 at that point) (step 110).

A dual binarization step is then applied to the raw image file (step 112). As used herein, dual binarization refers to constraining each point in the ultrasonic image file to one of three possible values (for example, −1, 0, +1) indicating a thicker than normal banknote substrate, a normal banknote substrate, and a thinner than normal banknote substrate, respectively. The ultrasonic sensors 30 operate like transmission sensors, so the lower the value, the thicker the substrate.

To implement dual binarization two thresholds are used. Any point value lower than the first threshold is assigned a value of −1. Any point value between the first and second thresholds (inclusive) is assigned a value of 0. Any point value higher than the second threshold is assigned a value of +1.

When the dual binarization step has been completed, the result is a quantized image, which is stored in the memory 38 (step 114).

Figure 3A:
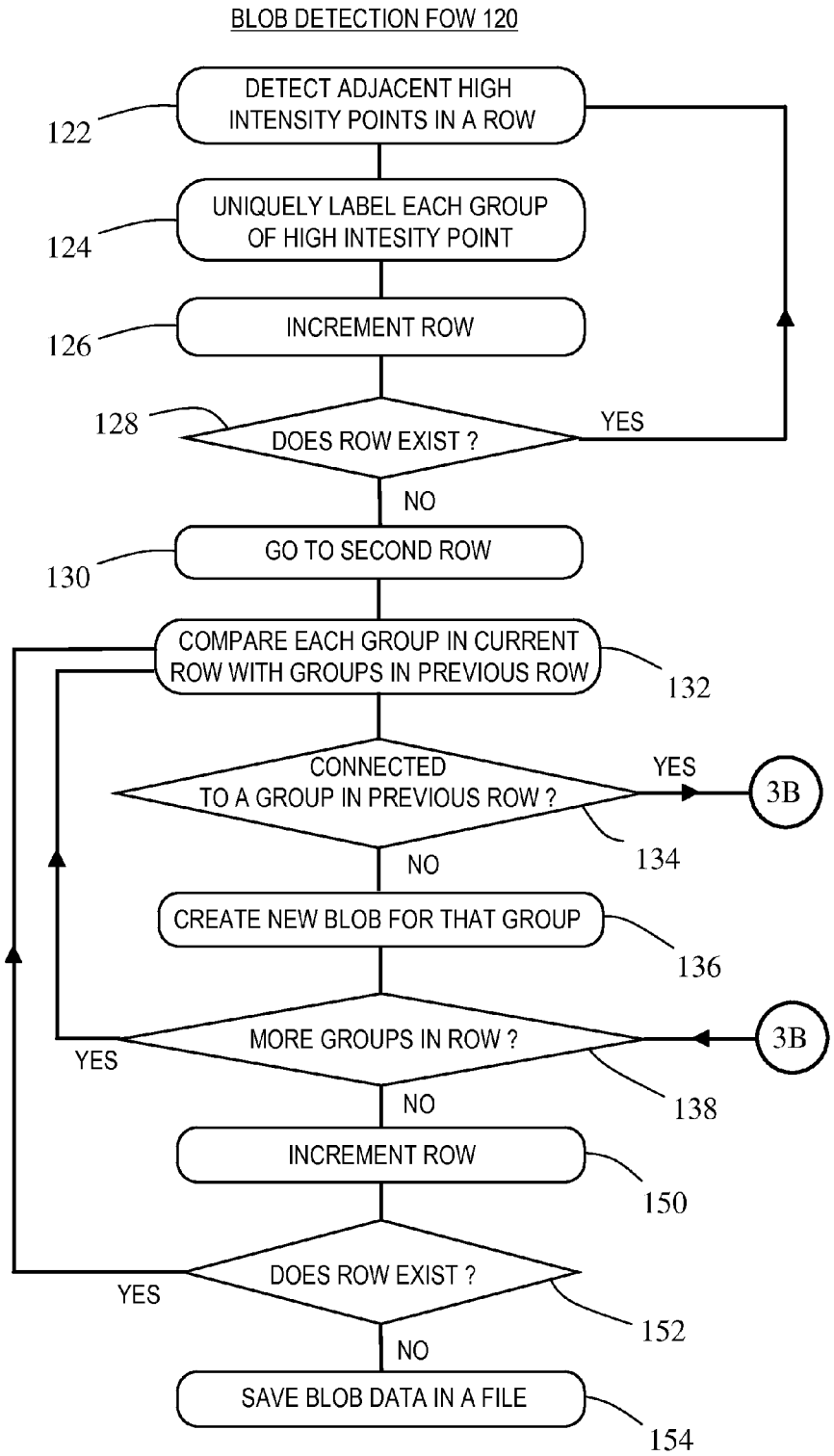
FIGS. 3A and 3B form a flowchart (split over two sheets in the drawings) illustrating steps implemented by part of the media validator of FIG. 1 (a Digital Signal Processor) in detecting potential defects in the media item.
Figure 3B:
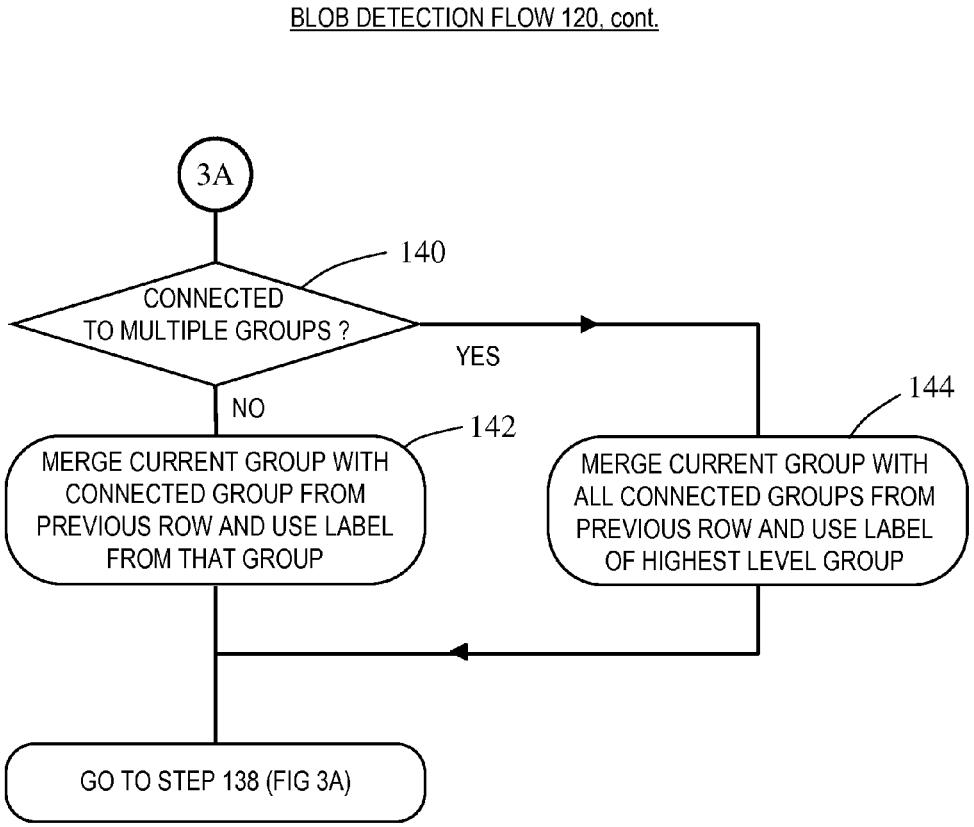

Reference will now also be made to FIGS. 3A through 3B, which is a flowchart 120 illustrating steps performed by the banknote validator 12 (as controlled by the DSP 36) to identify blobs in the quantized image. A "blob" (sometimes referred to as a binary large object) consists of contiguous areas of high value points, or contiguous areas of low value points.

Blob detection is performed using a modified union-find structure algorithm. The steps of flowchart 120 are implemented to detect blobs comprising thin areas. The steps of flowchart 120 are then implemented to detect blobs comprising thick areas. For simplicity of description, the steps of flowchart 120 will only be described in detail for thin areas, but the same steps will be performed, mutatis mutandis, for thick areas.

Initially, the DSP 36 detects all of the high intensity points (the thin area points) in the first row of the image (step 122). The DSP 36 then uniquely labels each contiguous group of high intensity points (step 124).

The DSP 36 then increments the row (step 126). If this new row exists (step 128) (that is, if the current row is not the last row), then step 122 is repeated for this next row. This continues until all of the rows have been analysed, and all groups of high intensity points have been identified.

Once all of the rows have been analysed, the DSP 36 then starts at the second row (step 130), and compares each group in that row (initially, the second row) with the groups in the previous row (initially, the first row) (step 132).

For each group in the current row (initially, the second row), the DSP 36 ascertains if that group overlaps any group in the previous row (step 134).

If a group in the current row does not overlap any group in the previous row then that group is assigned a unique blob number (step 136). This is referred to as a growing blob because it may increase in size, depending on whether it overlaps any groups in the next row, as described in more detail below.

The DSP 36 ascertains if there are any more groups left in the current row (step 138). If there are more groups, then steps 132 and 134 are repeated for those groups. If there are no more groups in the current row, then processing will continue as described below.

Returning to step 134, if a group in the current row does overlap any group in the previous row then the DSP 36 ascertains if the group overlaps one other group or multiple other groups (step 140) (see FIG. 3B).

If a group in the current row overlaps only one group in the previous row, then the DSP 36 merges the current group with that other group and either assigns a unique blob number to the new merged group (if this is the second row) or uses the assigned unique blob number assigned to that other group (if this is any row after the second row) (step 142). The effect of this is to merge groups that overlap and retain only a single blob identification number for the merged group.

If a group in the current row overlaps multiple groups in the previous row, then the DSP 36 merges the current group with all of the groups that overlap the current group to create a single merged group (step 144). The DSP 36 uses the unique blob identification for the highest level group in the merged group. This means that the identification is taken from the group that appeared in the earliest (first, second, third, etc.) of the rows containing the groups.

Regardless of whether one or multiple groups overlap the current group, the next step is for the DSP 36 to return to step 138 (FIG. 3A).

As mentioned above, step 138 is used to ensure that all of the groups in a row are processed before the DSP increments the row (step 150).

The DSP 36 ascertains if this new row exists (step 152). If this row exists, then steps 132 onwards are repeated for this new row.

If this new row does not exist (in other words, if the current row is the last row in the image), then blob detection is complete, and the position, identification, and dimensions (length, width, and area) of the detected high intensity blobs are all saved in the memory 38 by the DSP 36 in a blob identification file 40 (FIG. 1) (step 154).

In practical software implementations, the loop of steps 122 to 128 and the loop of steps 132 to 152 can be merged, and the abovementioned tasks of the adjacent high intensity point group detection and the subsequent group connectivity analysis and merge can be implemented in one scan of the ultrasonic image points.

The flow 120 is then repeated for low intensity points, and all detected low intensity blobs are also saved in the memory 38 by the DSP 36 in the blob identification file 40.

The blob identification file 40 now identifies all blobs in the ultrasonic image, whether these are high intensity blobs or low intensity blobs.

Figure 4A:
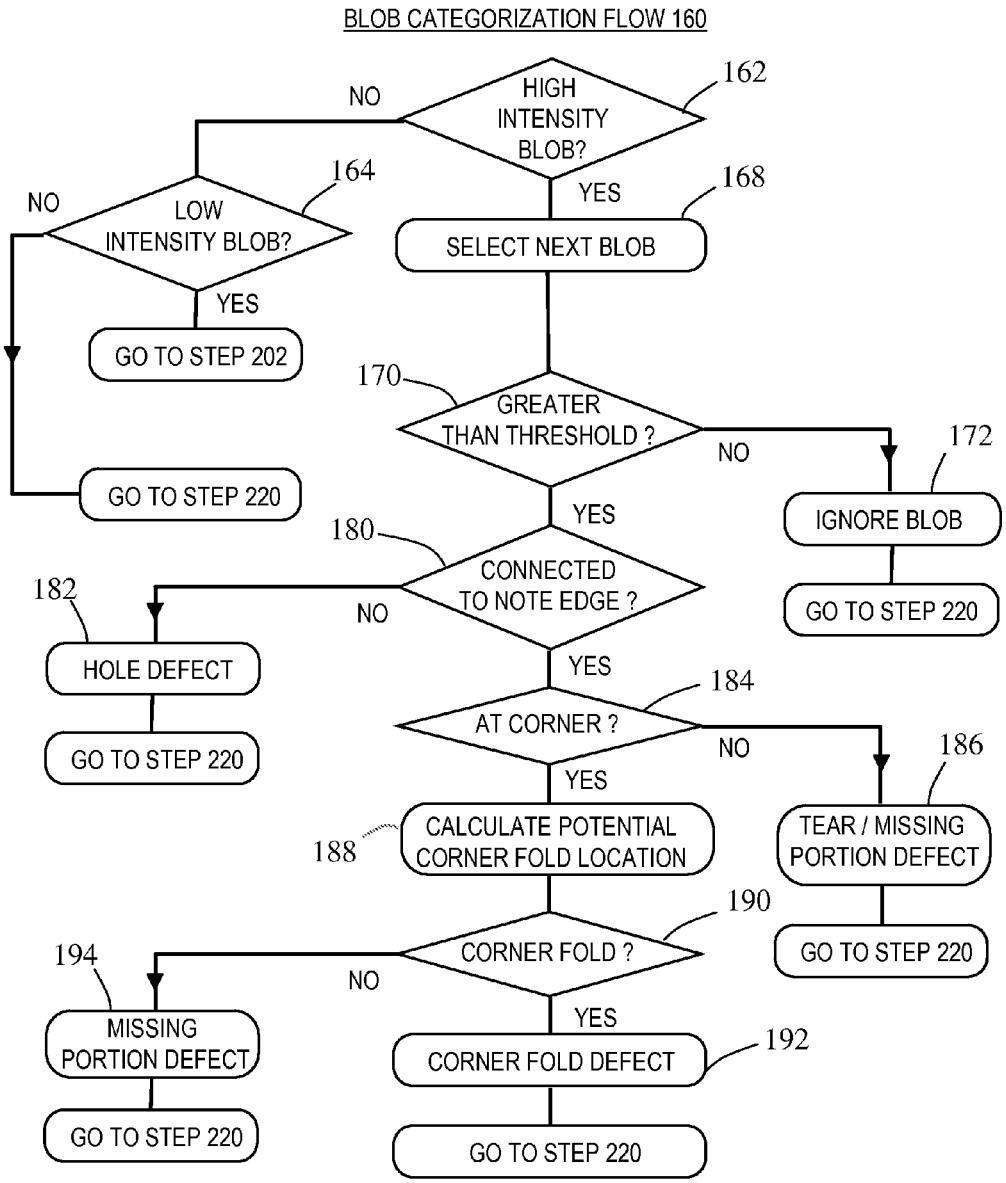
FIGS. 4A, 4B, and 4C form a flowchart illustrating steps performed by the Digital Signal Processor of FIG. 1 in categorizing the potential defects identified by the steps of FIGS. 3A and 3B.
Figure 4B:
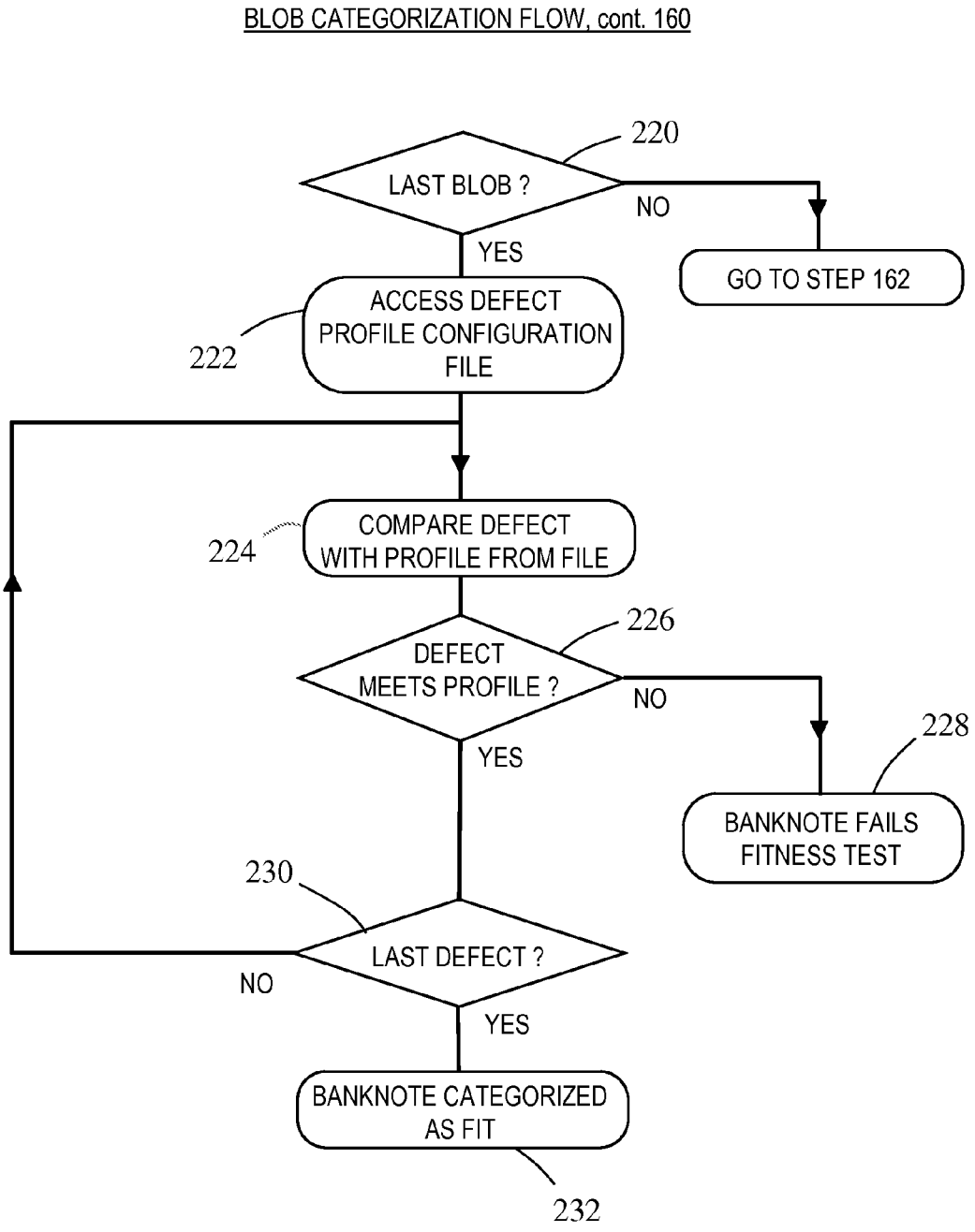
Figure 4C:
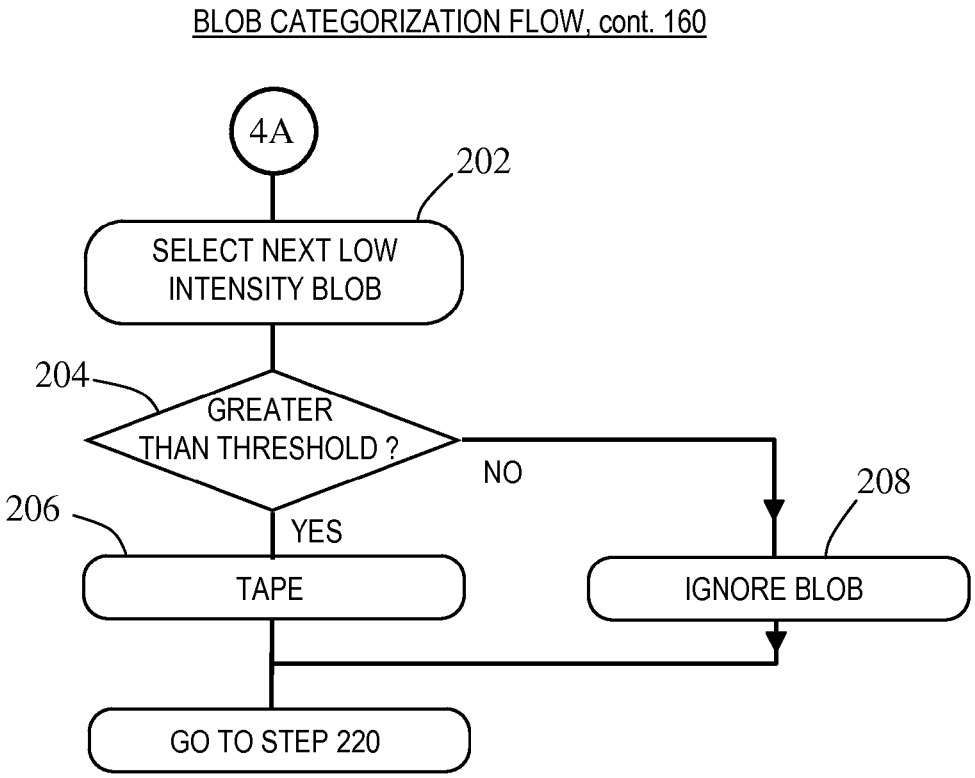

Reference will now be made to FIGS. 4A through 4C, which is a flowchart 160 illustrating steps performed by the DSP 36 in categorizing the identified blobs in the blob identification file 40. The high intensity blobs are categorized first and then the low intensity blobs are categorized.

The first step is to ascertain if there are any uncategorized high intensity blobs (step 162). If there are no uncategorized high intensity blobs, then the next step is to ascertain if there are any uncategorized low intensity blobs (step 164). If there are no uncategorized high intensity blobs and no low intensity blobs, then categorization is complete and the process moves to step 220, described below.

If there are uncategorized high intensity blobs, then the next step is to select the first (or next) uncategorized high intensity blob (step 168).

The DSP 36 then ascertains if this high intensity blob is greater than a defined area threshold (step 170). This defined area threshold may be specific to a particular currency (such as Euros) or denomination (such as a twenty dollar bill). In this embodiment the defined threshold is 8 $mm^2$.

If this high intensity blob is not greater than the defined area threshold then the blob is ignored as insignificant and the blob is marked as categorized (step 172) and the flow moves to step 220. An insignificant blob is categorized only to the extent of being labelled as insignificant or being deleted from the blob identification file 40.

If this high intensity blob is larger than (or equal in size to) the defined area threshold, then the DSP 36 ascertains if the detected blob is connected to an edge of the banknote 20 (step 180). In other words, the DSP 36 ascertains if the blob is an island in the central portion of the banknote, or if it touches an edge of the banknote.

If the detected blob is not connected to an edge of the banknote then it is categorized by the DSP 36 as a hole defect and the high intensity blob is marked as categorized (step 182) and the process moves to step 220 (described in more detail below).

If the detected blob is connected to an edge of the banknote then the DSP 36 ascertains if the detected blob is at one of the four corners of the banknote 20 (step 184).

If the detected blob is not located at a corner of the banknote 20 then it is categorized by the DSP 36 as a tear/missing portion defect and the high intensity blob is marked as categorized (step 186) and the process moves to step 220 (described in more detail below).

If the detected blob is located at a corner of the banknote 20 then the DSP 36 ascertains if the corner is missing, or if it is folded back on itself (referred to as a corner fold) (step 188).

There are at least two ways of implementing this. The simpler way involves ascertaining if there is a low intensity blob of approximately similar area to an adjacent high intensity blob. If this occurs, then there is a corner fold. The more complicated way involves calculations, as described below with reference to FIG. 5, which illustrates part of the banknote 20, with a corner edge folded back on itself.

Figures 5, 6:
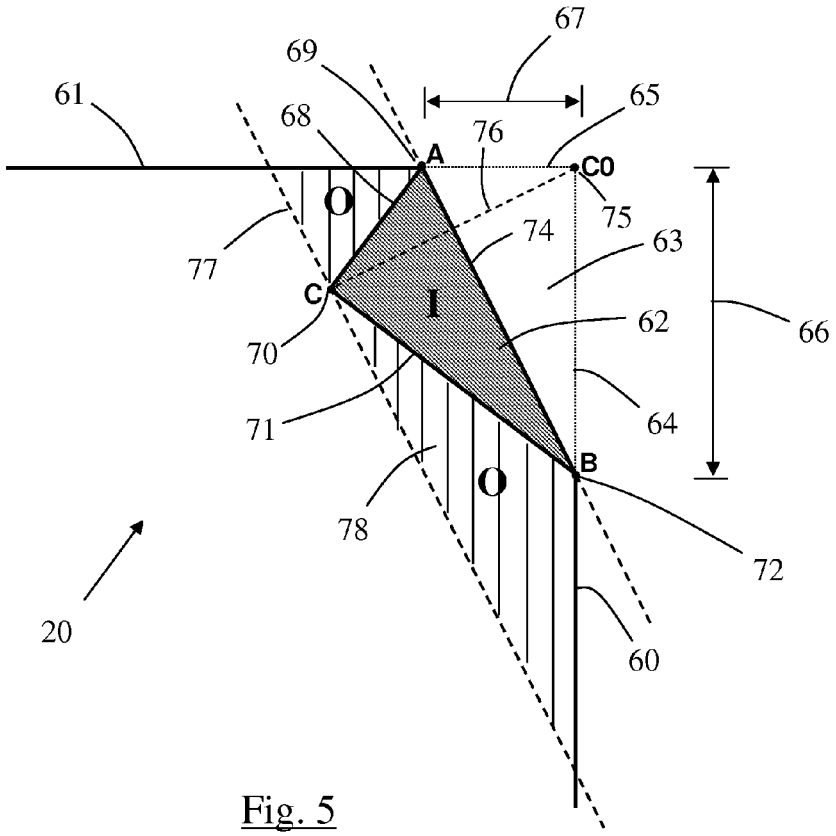
FIG. 5 is a pictorial drawing illustrating part of the media item, with a corner edge folded back on itself, together with boundary lines calculated by the DSP of FIG. 1.
FIG. 6 illustrates an example of entries from a defect profile configuration file that is used to classify defects categorized by the system of FIG. 1.

In FIG. 5, the banknote 20 has a vertical (short) edge 60 and a horizontal (long) edge 61. Part of the corner (labelled "I") is folded back on the top side of the banknote 20 to create a corner fold region 62, as shown by the dark grey portion in FIG. 5, leaving a void area 63. The void area 63 is shown more clearly in FIG. 5 by the broken vertical line portion 64 and the broken horizontal line portion 65. When this banknote 20 is quantized (dual binarized), there will be a high intensity blob corresponding in size and shape to the void area 63, and a low intensity blob corresponding in size and shape to the corner fold region (or overlap area) 62. The length of the broken vertical line 64 is illustrated by arrow 66; and the length of the broken horizontal line 65 is illustrated by arrow 67.

As can be seen from FIG. 5, the corner fold region 62 has an upper angled edge 68 extending from an upper fold point 69 (labelled "A") at which the horizontal line portion 67 starts, to an original corner point 70 (labelled "C"). The length of the upper angled edge 68 equals the length of arrow 67.

The corner fold region 62 also has a lower angled edge 71 extending from the original corner point 70 (labelled "C") to a lower fold point 72 (labelled "B") at which the vertical line portion 64 starts. The length of the lower angled edge 71 equals the length of arrow 66.

The corner fold region 62 also has a fold edge 74 that extends from the upper fold point 69 (labelled "A") to the lower fold point 72 (labelled "B").

The banknote's original corner position 75 (that is, if the corner had not been folded back) is shown at the junction of the two line portions 64,65 and is labelled "C0".

A bisecting line 76 is shown extending from the original corner position 75 (labelled "C0") to the original corner point 70 (labelled "C") and passing through the fold edge 74 at right angles thereto.

An overlap limit line 77 is shown extending parallel to the fold edge 74 and passing through the original corner point 70 (labelled "C"). The non-overlap area 78 (labelled "O"), which is between the overlap limit line 77, the corner fold region 62, the vertical edge 60, and the horizontal edge 61, is shown with vertical lines.

The detected blob (equivalent to void area 63) that corresponds to this corner fold region 62 will directly provide the co-ordinates for the upper fold point 69 (labelled "A") and the lower fold point 72 (labelled "B") because the detected blob will correspond to the shape of the corner fold region 62. Since these points are connected by straight lines, these lines can be estimated using the following equation (equation 1):

$$y=mx+c \qquad \text{equation 1}$$

In equation 1, m is the gradient of the line and c is point at which it passes through the y axis (the intersection point).

Using the co-ordinates for the upper fold point 69 (labelled "A") and the lower fold point 72 (labelled "B"), the DSP 36 can estimate the gradient (k) and intersection point (b) for the fold edge 74.

The DSP 36 accesses the normalised image stored in the raw image file 39 from (which was stored in the memory 38 in step 110).

The DSP 36 can extrapolate lines 60 and 61 from the normalised image to calculate the original corner position 75 (labelled "C0"). Once the original corner position 75 is known, it can be symmetrically projected about the fold edge 74 (since the equation for the fold edge is now known) to locate the original corner point 70 (labelled "C").

Once the original corner point 70 (labelled "C") is known, the DSP 36 uses the co-ordinates for the upper fold point 69 (labelled "A") and the original corner point 70 (labelled "C") to estimate the gradient (l) for the upper angled edge 68.

The DSP 36 also uses the co-ordinates for the original corner point 70 (labelled "C") and the lower fold point 72 (labelled "B") to estimate the gradient (r) for the lower angled edge 71.

Once the DSP 36 has calculated the position of the original corner point 70 (labelled "C"), it can then calculate the equation for the overlap limit line 77. This is because the original corner point 70 (labelled "C") is on the overlap line 77, and the gradient of the overlap line (k) is the same as the gradient of the fold edge 74.

At this stage, the DSP 36 has calculated the potential corner fold location.

The next step is for the DSP 36 to ascertain if there is a corner fold or a missing portion (step 190). To do this, the DSP 36 accesses the list of identified low intensity blobs from the blob identification file 40. If there is a low intensity blob adjacent to the high intensity blob and that has approximately the same dimensions as the calculated corner fold region 62, then the high intensity blob is identified as a corner fold and the high and low intensity blobs are both marked as categorized (step 192). However, if there is no low intensity blob adjacent to the high intensity blob, or if the shape and/or size of the low intensity blob is significantly different to that of the corner fold region then the blob is identified as a missing corner rather than a corner fold and the high intensity blob is marked as categorized (step 194).

Regardless of how the blob has been categorized, the next step is to ascertain if this is the last blob to be categorized (step 220).

If there are still uncategorized blobs, then the DSP 36 returns to step 162 as often as necessary until all of the detected high intensity blobs have been categorized.

Once all of the high intensity blobs have been categorized (or marked as categorized or deleted because they are insignificant), the DSP 36 ascertains if there are any low intensity blobs yet to be categorized (step 164).

If there are still some low intensity blobs yet to be categorized, then the DSP 36 selects the first (or next) low intensity blob (step 202).

The DSP 36 ascertains if this low intensity blob is greater than the defined area threshold (step 204).

If this low intensity blob is greater than the defined area threshold then the blob is categorized as a tape defect (step 206), and the process moves to step 220.

If this low intensity blob is not greater than the defined area threshold then the blob is ignored as insignificant and the blob is marked as categorized (step 208).

The process then moves to step 220.

At step 220, the DSP 36 ascertains if there are any remaining uncategorized blobs in the blob identification file 40.

If there are more uncategorized blobs, then the flow reverts to step 162.

If there are no more uncategorized blobs, then the DSP 36 accesses a defect profile configuration file 42 (FIG. 1) stored in the memory 38 (step 222). The defect profile configuration file 42 includes an entry for each defect type. FIG. 6 illustrates an example of entries from the defect profile configuration file 42. Each entry includes: a defect type parameter; a defect size field; and a logic parameter.

As shown in FIG. 6, there is an entry 300 for a hole defect type. Each line includes the defect type parameter ("hole") as part of the line. The first line 302 includes the defect size field (which comprises a single defect size parameter, namely an area equal to ten square millimeters); and the second line 304 includes the logic parameter (in this example, no logical connector is needed). This entry means that if a hole type of defect is detected that has an area greater than or equal to 10 $mm^2$, then the banknote having that defect should be characterized as unfit.

Entry 310 is for a corner fold defect. The defect size field comprises two defect size parameters. The first line 312 indicates an area of 130 $mm^2$ (which is the first defect size parameter); the second line 314 indicates a length of 10 mm (which is the second defect size parameter); and the third line 316 indicates that there is a logical AND connection between the two different size parameters. In other words, if a corner fold type of defect is detected that has an area greater than or equal to 130 $mm^2$ AND a length greater than or equal to 10 mm, then the banknote having that defect should be characterized as unfit (since neither size parameter is satisfied). If only one of these size parameters is not satisfied, then the banknote should be characterized as fit (unless other defects are present that would lead to a contrary result).

Entry 320 is for a missing portion defect. The first line 322 indicates a length of 6 mm, the second line 324 indicates a width of 5 mm; and the third line 326 indicates that there is a logical OR connection between the two different size parameters. In other words, if a missing portion type of defect is detected that has a length greater than or equal to 6 mm OR a width greater than or equal to 5 mm, then the banknote having that defect should be characterized as unfit. If neither of these size parameters is met, then the banknote should be characterized as fit (unless other defects are present that would lead to a contrary result).

Returning to the flowchart of FIG. 4B, at step 224 the DSP 36 compares each categorized defect with the corresponding entry from the defect profile configuration file 42. This is to ascertain if that defect satisfies the defect profile (step 226).

The position, identification, and dimensions (length, width, and area) of the detected blobs were all saved in the blob identification file 40, which the DSP 36 accesses as part of this step.

If a categorized defect does not satisfy the defect profile (for example, because a hole type of defect has an area exceeding 10 $mm^2$), then the banknote 20 is characterized as unfit for continued circulation (step 228).

If the categorized defect does satisfy the defect profile, then the next step is for the DSP 36 to ascertain if there are any remaining categorized blobs that need to be compared with the defect profile configuration file 42 (step 230).

If there are still some remaining categorized blobs that need to be compared with the defect profile configuration file 42, then the DSP 36 returns to step 224 as often as necessary until all of the categorized blobs have been compared with the defect profile configuration file 42.

Once all of the categorized blobs have been assessed, then the banknote 20 is characterized as fit for continued circulation if all of the categorized blobs satisfy the defect profile configuration file 42 (step 232). However, if even one categorized blob does not satisfy the defect profile configuration file 42, then the banknote 20 is characterized as unfit and should be removed from circulation. This may be implemented by segregating the banknote 20 in a different storage compartment within a media depository in which the banknote validator 12 is mounted.

The categorization and banknote fitness characterization then stops.

This embodiment has the advantage that it can be implemented rapidly while the banknote is being validated. The defect profile configuration file can be easily updated to accommodate changes in defect size parameters that are considered unacceptable. This embodiment only requires non-optical image information to make a determination about the defect categorization; although optical image information may be used to assist the determination, for example, by indicating the edges of the banknote, this is not required, merely optional.

Various modifications may be made to the above described embodiment within the scope of the invention, for example, media items other than banknotes may have damage categorized using this technique.

In other embodiments, a different blob detection algorithm may be used than that described above.

In other embodiments, a different defect categorization process may be used. For example, a tear/missing portion defect type may be further categorized as either a tear or missing portion by comparing the size of the blob with a threshold size for a missing portion. If the detected blob is smaller than the threshold size, then the detected blob is a tear; if equal to or larger than the threshold size, then the detected blob is a missing portion.

In other embodiments, different numerical methods may be used to estimate the location of points on a corner fold. For example, the original corner point 70 ("C") may be calculated using the lengths of the broken vertical line 64 and horizontal line 65 (66 and 67 respectively). The original corner point 70 being the intersection of an arc centred on upper fold point 69 ("A") having a radius equal to length 67 and an arc centred on lower fold point 72 ("B") having a radius equal to length 66.

In other embodiments, a different data structure may be used for the defect profile configuration file.

In other embodiments, the defect size parameters may be different to those described above.

In other embodiments, a different transport may be used than that described.

The steps of the methods described herein may be carried out in any suitable order, or simultaneously where appropriate. The methods described herein may be performed by software in machine readable form on a tangible storage medium or as a propagating signal.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

The presence of broadening words and phrases such as "one or more," "at least," "but not limited to" or other similar phrases in some instances does not mean, and should not be construed as meaning, that the narrower case is intended or required in instances where such broadening phrases are not used.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of categorizing defects in a banknote, the method comprising the steps of: receiving a quantized ultrasonic image of the banknote, where the quantized ultrasonic image comprises a plurality of points, each point having a thickness value corresponding to a normal value, a thin value, or a thick value;

identifying one or more blobs comprising contiguous points each having a thickness value corresponding to a thin value;

for each identified blob, comparing a size of the blob with a damage criterion;

ignoring the blob if the blob size does not meet the damage criterion; and for each identified blob having a size meeting the damage criterion, categorizing the identified blob using the thickness values and locations.

2. A method according to claim 1, wherein the step of identifying one or more blobs includes using a region growing algorithm.

3. A method according to claim 1, wherein the step of identifying one or more blobs includes storing, for each complete blob, the blob location, size and dimensions.

4. A method according to claim 1, wherein the step of categorizing the identified blob includes the categories of: tear, missing portion, corner fold, hole, and tape.

5. A method according to claim 1, wherein the step of categorizing the identified blob comprises the further step of: (a) categorizing the identified 25 blob as a hole if the blob does not touch one of the edges of the banknote.

6. A method according to claim 1, wherein the method comprises the further steps of:

identifying one or more blobs comprising contiguous points each having a thickness value corresponding to a thick value;

for each identified blob, comparing a size of the blob with a damage criterion;

ignoring the blob if the blob size does not meet the damage criterion; and for each identified blob having a size meeting the damage criterion, categorizing the identified blob as tape if it is not connected to a blob comprising contiguous points each having a thickness value corresponding to a thin value.

7. A method according to claim 1, wherein the method comprises 10 the further step of applying fitness rules to the categorized blobs to ascertain if the banknote should be classified as unfit.

8. A method according to claim 1, wherein the method comprises the further step of capturing an ultrasonic image of the banknote and then creating a quantised image from the captured image prior to the step of 15 receiving a quantised ultrasonic image of the banknote.

9. A method according to claim 1, wherein the method comprises the further step of adjusting spatial dimensions of the received image so that the received image matches spatial dimensions of a reference for that banknote.

10. A banknote validator operable to categorize defects on a banknote presented thereto, the banknote validator comprising: a banknote transport for transporting a banknote; an ultrasonic transceiver aligned with the banknote transport and for capturing a two-dimensional array of points corresponding to the banknote, each point having a point value relating to a thickness of the banknote at a spatial location on the banknote corresponding to that point; and a processor programmed to control the banknote transport and the ultrasonic transceiver, and also programmed to:

(a) quantise the captured array of points to create a quantised ultrasonic image, (b) identify one or more blobs comprising contiguous points each having a point value corresponding to a thin value, (c) ascertain if which identified blobs meet a damage criterion, and (d) categorize those identified blobs meeting the damage criterion.

11. A banknote validator according to claim 10, further comprising a banknote store.

12. A method of categorizing defects in a banknote, the method comprising the steps of: receiving an ultrasonic image of the banknote;

identifying one or more blobs having an abnormal thickness value; and categorizing an identified blob using the thickness value and a location of that identified blob.

* * * * *